US006203284B1

(12) United States Patent
Kawaguchi et al.

(10) Patent No.: US 6,203,284 B1
(45) **Date of Patent: *Mar. 20, 2001**

(54) VALVE ARRANGEMENT AT THE DISCHARGE CHAMBER OF A VARIABLE DISPLACEMENT COMPRESSOR

(75) Inventors: Masahiro Kawaguchi; Masanori Sonobe; Ken Suitou; Tetsuhiko Fukanuma; Hiroyuki Nagai; Yoshihiro Makino; Shintaro Miura, all of Kariya (JP)

(73) Assignee: Kabushiki Kaisha Toyoda Jidoshokki Seisakusho, Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/810,409

(22) Filed: Mar. 4, 1997

Related U.S. Application Data

(63) Continuation-in-part of application No. 08/735,671, filed on Oct. 23, 1996.

(30) Foreign Application Priority Data

| | | |
|---|---|---|
| Oct. 26, 1995 | (JP) | 7-279338 |
| Mar. 12, 1996 | (JP) | 8-054866 |
| Nov. 22, 1996 | (JP) | 8-312308 |

(51) Int. Cl.[7] ..... F04B 1/26
(52) U.S. Cl. ..... 417/222.2; 417/269; 417/270
(58) Field of Search ..... 417/222.2, 269, 417/270, 312; 92/73; 91/499

(56) References Cited

U.S. PATENT DOCUMENTS

| | | | |
|---|---|---|---|
| 4,533,299 | 8/1985 | Swain et al. . | |
| 5,391,058 * | 2/1995 | Goto et al. | 417/269 |
| 5,529,461 * | 6/1996 | Kawaguchi et al. | 417/269 |
| 5,577,894 * | 11/1996 | Kawaguchi et al. | 417/222.2 |

FOREIGN PATENT DOCUMENTS

| | | | |
|---|---|---|---|
| 3416637 | 11/1985 | (DE) . | |
| 44 39 512 A1 | 5/1995 | (DE) . | |
| 0628722 | 12/1994 | (EP) . | |
| 0 707 182 A2 | 4/1996 | (EP) . | |
| 1257777 | 10/1989 | (JP) | 417/222.2 |
| 7127566 | 5/1995 | (JP) | 417/269 |

* cited by examiner

*Primary Examiner*—Timothy Thorpe
*Assistant Examiner*—Cheryl J. Tyler
(74) *Attorney, Agent, or Firm*—Morgan & Finnegan, L.L.P.

(57) ABSTRACT

A compressor has a cam plate located in a crank chamber and mounted on a drive shaft and a piston coupled to the cam plate and located in a cylinder bore. The piston compresses gas supplied to the cylinder bore from a separate external circuit by way of a suction chamber and discharges the compressed gas to the external circuit by way of a discharge chamber. The cam plate is tiltable between a maximum inclined angle position and a minimum inclined angle position with respect to a plane perpendicular to an axis of the drive shaft according to a difference between the pressure in the crank chamber and the pressure in the cylinder bore. The piston moves by the stroke based on an inclination of the cam plate to control the displacement of the compressor. A valve is placed between the discharge chamber and the external circuit. The valve selectively connects and disconnects the discharge chamber with the external circuit based on a difference between the pressure acting on the upstream side of the valve and the pressure acting on the downstream side of the valve.

25 Claims, 9 Drawing Sheets

VALVE ARRANGEMENT AT THE DISCHARGE CHAMBER OF A VARIABLE DISPLACEMENT COMPRESSOR

This application is a continuation-in-part of application Ser. No. 08/735,671, filed Oct. 23, 1996, U.S. Pat. No. 5,871,337.

BACKGROUND OF THE INVENTION

1. Field of the Invention

The present invention relates to variable displacement compressors that are used in vehicle air conditioners. More particularly, the present invention relates to a variable displacement compressor that changes its displacement by adjusting the inclination of a cam plate.

2. Description of the Related Art

Variable displacement compressors typically have a cam plate that is tiltably supported on a drive shaft. The inclination of the cam plate is controlled based on the difference between the pressure in a crank chamber and the pressure in cylinder bores. The stroke of each piston is varied by the inclination of the cam plate.

Variable displacement compressors often have a drive shaft directly connected to an external drive source such as an engine without a clutch located in between. In this clutchless system, the compressor continues to operate even when refrigeration is unnecessary or when frost is being formed in the evaporator. Japanese Unexamined Patent Publications No. 3-37378 and 7-127566 disclose variable displacement compressors that stop the circulation of refrigerant gas when refrigeration is unnecessary or when frost is being formed in the evaporator.

In a compressor according to Japanese Unexamined Patent Publication No 3-37378, introduction of refrigerant gas from an external refrigerant circuit into a suction chamber is stopped by an electromagnetic valve, thereby stopping the gas circulation. The electromagnetic valve, however, opens or shuts the passage between the external refrigerant circuit and the suction chamber too quickly. This suddenly increases or decreases the amount of gas entering the cylinder bores from the suction chamber. Sudden changes in the amount of gas flow into the cylinder bores results in abrupt fluctuation of the compressor's displacement. Accordingly, the compressor's discharge pressure fluctuates. This significantly varies the load torque of the compressor, that is, the torque necessary for operating the compressor, in a short time.

A compressor according to Japanese Unexamined Patent Publication No. 7-127566 has a valve located in a discharge passage that connects the discharge chamber and an external refrigerant circuit. When the difference between the pressure in the discharge chamber (discharge pressure) and the pressure in the suction pressure area (suction pressure) is equal to or below a predetermined level, the valve closes the discharge passage to stop refrigerant gas flow from the compressor to the external circuit. The difference between the discharge pressure and the suction pressure changes slowly. Accordingly, the valve slowly changes the cross-sectional area of the passage, through which refrigerant gas is discharged from the discharge chamber to the external refrigerant circuit, in accordance with the difference between the discharge pressure and the suction pressure. This results in mild fluctuations of the gas flow amount from the discharge chamber to the external circuit. Sudden changes in the compressor's load torque are thus prevented.

The above described valve includes a cylindrical valve body. The valve body has a face for receiving the discharge pressure and another face for receiving the suction pressure. The suction pressure receiving face is located opposite to the discharge pressure receiving face. The valve body moves along the axis thereof in accordance with difference between the pressures acting on the faces. A large difference between the pressures causes the highly pressurized refrigerant gas in the discharge chamber to leak into the suction pressure area through the clearance between the periphery of the valve body and the wall of the chamber accommodating the valve body. The gas leak deteriorates the refrigerant efficiency of the external refrigerant circuit.

SUMMARY OF THE INVENTION

Accordingly, it is an objective of the present invention to provide a compressor that prevents abrupt changes in the compressor's load torque without deteriorating the refrigerant efficiency. The compressor also prevents the generation of frost.

To achieve the above object, the compressor according to the present invention has a cam plate located in a crank chamber and mounted on a drive shaft and a piston coupled to the cam plate and located in a cylinder bore. The cam plate converts rotation of the drive shaft to reciprocating movement of the piston in the cylinder bore to vary the capacity of the cylinder bore. The piston compresses gas supplied to the cylinder bore from a separate external circuit by way of a suction chamber and discharges the compressed gas to the external circuit by way of a discharge chamber. The cam plate is tiltable between a maximum inclined angle position and a minimum inclined angle position with respect to a plane perpendicular to an axis of the drive shaft according to a difference between the pressure in the crank chamber and the pressure in the cylinder bore. The piston moves by the stroke based on an inclination of the cam plate to control the displacement of the compressor. A valve is placed between the discharge chamber and the external circuit. The valve selectively connects and disconnects the discharge chamber with the external circuit based on a difference between the pressure acting on the upstream side of the valve and the pressure acting on the downstream side of the valve.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

FIG. 11(*b*) is an enlarged partial cross-sectional view illustrating a compressor according to a third embodiment when a check valve is opened.

DETAILED DESCRIPTION OF THE PREFERRED EMBODIMENTS

A first embodiment of a variable displacement compressor according to the present invention will now be described with reference to FIGS. 1 to 7.

Figure 1:
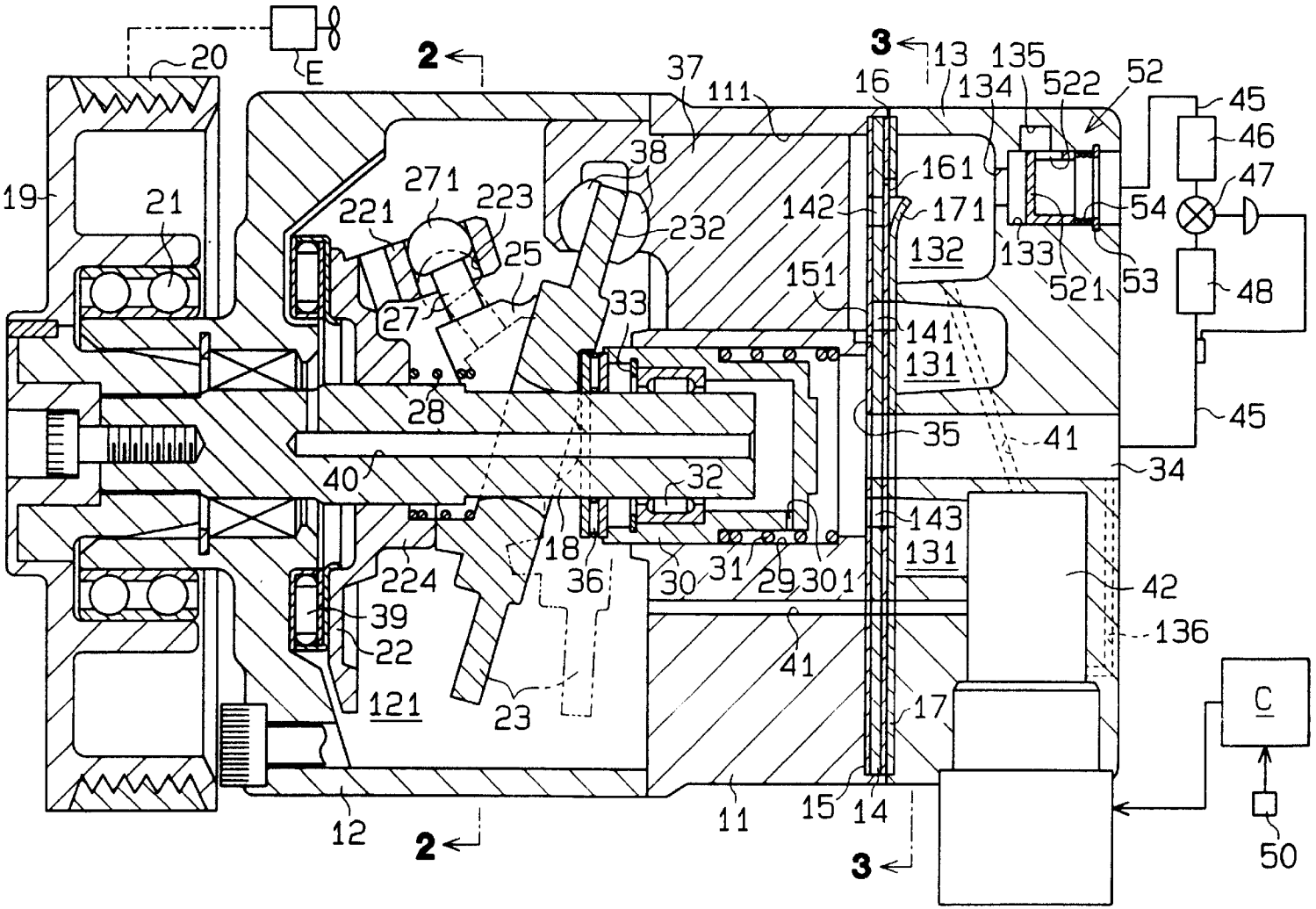
FIG. 1 is a cross-sectional view illustrating a variable displacement compressor according to a first embodiment of the present invention.

As shown in FIG. 1, a front housing 12 is secured to the front end face of a cylinder block 11. A rear housing 13 is secured to the rear end face of the cylinder block 11 with a first plate 14, a second plate 15, a third plate 16 and a fourth plate 17 provided in between. A crank chamber 121 is defined by the inner walls of the front housing 12 and the front end face of the cylinder block 11.

A drive shaft 18 is rotatably supported in the front housing 12 and the cylinder block 11. The front end of the drive shaft 18 protrudes from the crank chamber 121 and is secured to a pulley 19. The pulley 19 is directly coupled to an external drive source (a vehicle engine E in this embodiment) by a belt 20. The compressor of FIG. 1 is a clutchless type variable displacement compressor having no clutch between the drive shaft 18 and the external drive source. The pulley 19 is supported by the front housing 12 with an angular bearing 21 located in between. The front housing 12 carries thrust and radial loads that act on the pulley 19 via the angular bearing 21.

Figure 2:
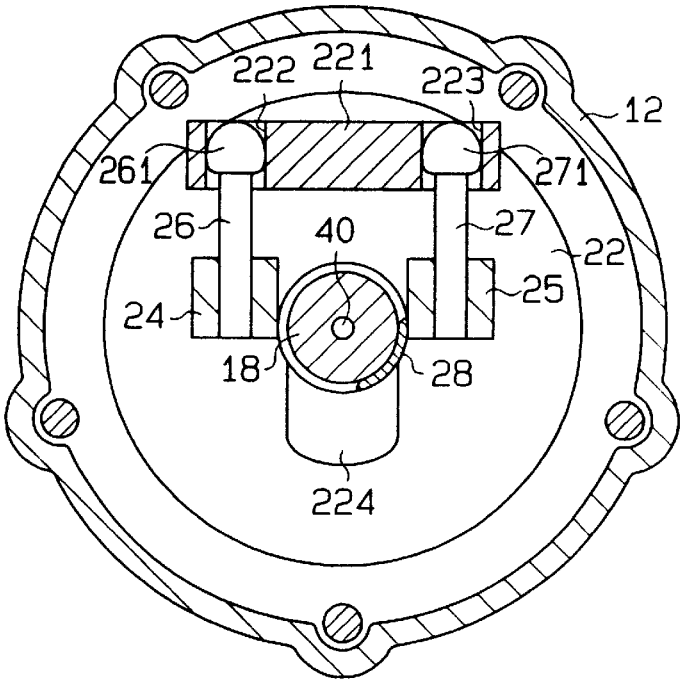
FIG. 2 is a cross-sectional view taken along line 2—2 of FIG. 1.

A substantially disk-like swash plate 23 is supported by the drive shaft 18 in the crank chamber 121 as to be slidable along and tiltable with respect to the axis of the shaft 18. As shown in FIGS. 1 and 2, the swash plate 23 is provided with a pair of guiding pins 26, 27, each having a guide ball 261, 271. The guiding pins 26, 27 are fixed to the swash plate 23 by stays 24, 25, respectively. A rotor 22 is fixed to the drive shaft 18 in the crank chamber 121. The rotor 22 rotates integrally with the drive shaft 18. The rotor 22 has a support arm 221 protruding toward the swash plate 23. A pair of guide holes 222, 223 are formed in the support arm 221. Each guide ball 261, 271 is slidably fit into the corresponding guide hole 222, 223. The cooperation of the arm 221 and the guide pins 26, 27 permits the swash plate 23 to rotate together with the drive shaft 18. The cooperation also guides the tilting of the swash plate 23 and the movement of the swash plate 23 along the axis of the drive shaft 18. As the swash plate 23 slides toward the cylinder block 11, or backward, the inclination of the swash plate 23 decreases.

A coil spring 28 is located between the rotor 22 and the swash plate 23. The spring 28 urges the swash plate 23 backward, or in a direction to decrease the inclination of the swash plate 23.

Figure 3:
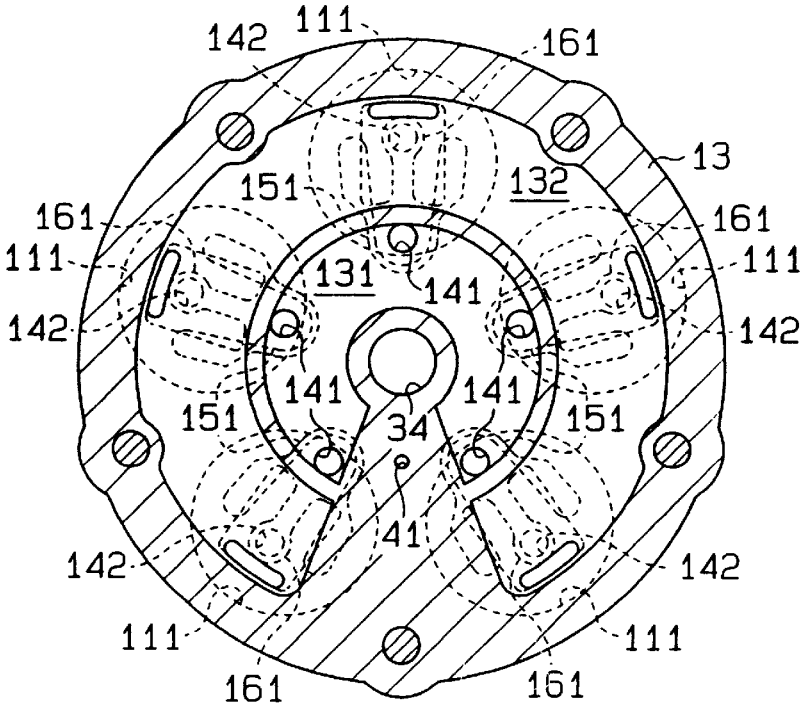
FIG. 3 is a cross-sectional view taken along line 3—3 of FIG. 1.

As shown in FIGS. 1 and 3, a plurality of cylinder bores 111 are defined extending through the cylinder block 11 about the drive shaft 18. The bores 111 are arranged parallel to the axis of the drive shaft 18 with a predetermined interval between each adjacent bore 111. A single-headed piston 37 is housed in each bore 111. A pair of semispherical shoes 38 are fitted between each piston 37 and the swash plate 23. The semispherical portion and a flat portion are defined on each shoe 38. The semispherical portion slidably contacts the piston 37 while the flat portion slidably contacts the swash plate 23. The swash plate 23 rotates integrally with the drive shaft 18. The rotating movement of the swash plate 23 is transmitted to each piston 37 through the shoes 38 and converted to a linear reciprocating movement of each piston 37 in the associated cylinder bore 111.

As shown in FIGS. 1 and 3, an annular suction chamber 131 is defined in the rear housing 13. An annular discharge chamber 132 is defined around the suction chamber 131 in the rear housing 13. Suction ports 141 and discharge ports 142 are formed on the first plate 14. Each suction port 141 and each discharge port 142 correspond to one of the cylinder bores 111. Suction valves 151 are formed on the second plate 15. Each suction valve 151 corresponds to one of the suction ports 141. Discharge valves 161 are formed on the third plate 16. Each discharge valve 161 corresponds to one of the discharge ports 142.

As each piston 37 moves from the top dead center to the bottom dead center in the associated cylinder bore 111, refrigerant gas in the suction chamber 131 is drawn into the cylinder bore 111 through the associated suction port 141 and the associated suction valve 151. As each piston 37 moves from the bottom dead center to the top dead center in the associated cylinder bore 111, refrigerant gas is compressed in the cylinder bore 111 and discharged to the discharge chamber 132 through the associated discharge port 142 and the associated discharge valve 161. Retainers 171 are formed on the fourth plate 17. Each retainer 171 corresponds to one of the discharge valves 161. The opening of each discharge valve 161 is restricted by the contact of the valve 161 and the associated retainer 171.

A thrust bearing 39 is located between the front housing 12 and the rotor 22. The thrust bearing 39 carries the compression reactive force acting on the rotor 22 from the pistons 37 and the swash plate 23.

Figure 4:
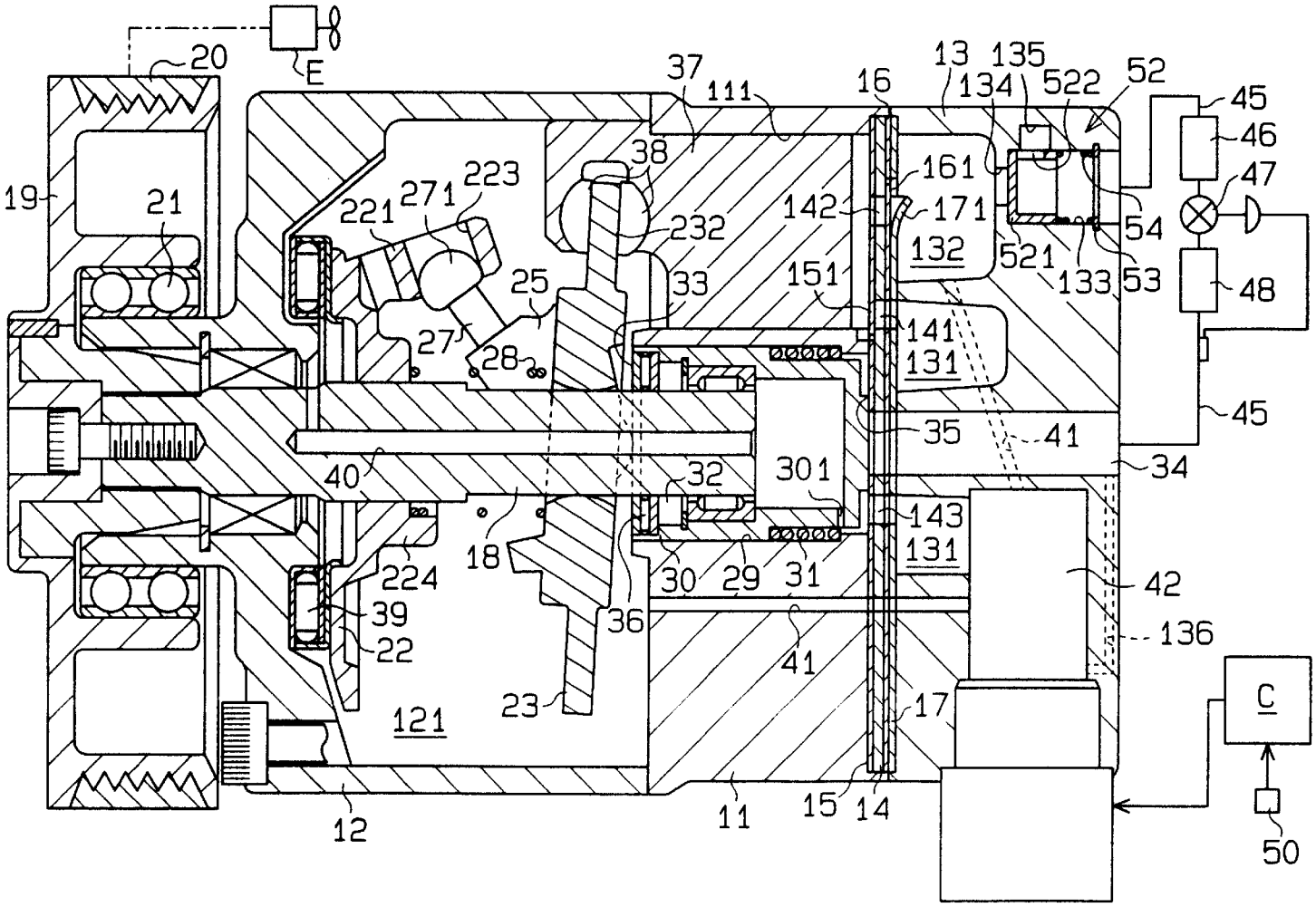
FIG. 4 is a cross-sectional view illustrating a variable displacement compressor when the inclination of the swash plate is minimal.

As shown in FIGS. 1 and 4, a shutter chamber 29 is defined in the center of the cylinder block 11, extending along the axis of the drive shaft 18. The shutter chamber 29 is communicated with the suction chamber 131 by a communication hole 143. A hollow cylindrical shutter 30 is accommodated in the shutter chamber 29 and is slidable along the axis of the drive shaft 18. A coil spring 31 is located between the shutter 30 and a wall of the shutter chamber 29. The coil spring 31 urges the shutter 30 toward the swash plate 23.

The rear end of the drive shaft 18 is inserted in the shutter 30. The radial bearing 32 is fixed to the inner wall of the shutter 30 by a circlip 33. Therefore, the radial bearing 32 moves with the shutter 30 along the axis of the drive shaft 18. The rear end of the drive shaft 18 is supported by the inner wall of the shutter chamber 29 with the radial bearing 32 and the shutter 30 in between.

A suction passage 34 is defined in the center portion of the rear housing 13 and the first to fourth plates 14 to 17. The passage 34 extends along the axis of the drive shaft 18 and is communicated with the shutter chamber 29. A positioning surface 35 is formed on the second plate 15 about the inner end of the suction passage 34. The rear end face of the shutter 30 is engageable with the positioning surface 35.

Engagement of the shutter 30 with the positioning surface 35 prevents the shutter 30 from further movement backward away from the swash plate and disconnects the suction passage 34 from the shutter chamber 29.

A thrust bearing 36 is supported on the drive shaft 18 and is located between the swash plate 23 and the shutter 30. The thrust bearing 36 slides along the axis of the drive shaft 18. The force of the coil spring 31 constantly retains the thrust bearing 36 between the swash plate 23 and the shutter 30. The thrust bearing 36 prevents the rotation of the swash plate 23 from being transmitted to the shutter 30.

The swash plate 23 moves backward as its inclination decreases. As it moves backward, the swash plate 23 pushes the shutter 30 backward by the thrust bearing 36. Accordingly, the shutter 30 moves toward the positioning surface 35 against the force of the coil spring 31. As shown in FIG. 4, when the swash plate 23 reaches the minimum inclination, the rear end face of the shutter 30 contacts the positioning surface 35. This locates the shutter 30 at the closed position where the shutter 30 disconnects the shutter chamber 29 from the suction passage 34.

A pressure release passage 40 is defined in the central portion of the drive shaft 18. The pressure release passage 40 connects the crank chamber 121 with the interior of the shutter 30. A pressure release hole 301 is formed in the peripheral wall near the rear end of the shutter 30. The hole 301 communicates the interior of the shutter 30 with the shutter chamber 29.

A discharge passage 133 is defined in the rear housing 13 and is connected with the discharge chamber 132. An external refrigerant circuit 45 connects the discharge passage 133 with the suction passage 34. The external refrigerant circuit 45 includes a condenser 46, an expansion valve 47 and an evaporator 48. The expansion valve 47 controls the flow rate of the refrigerant in accordance with the fluctuation of the gas temperature at the outlet of the evaporator 48.

Figure 5:
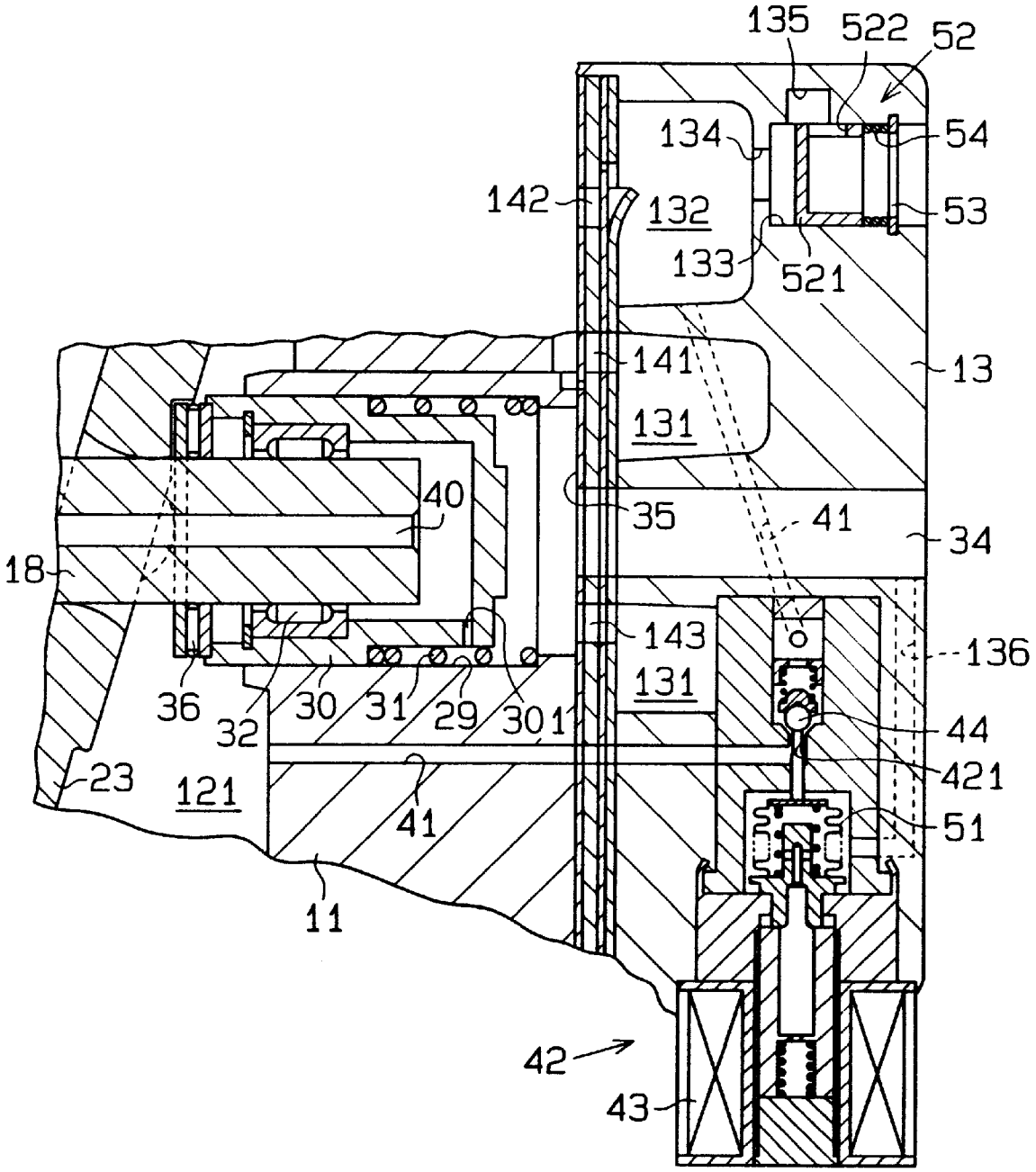
FIG. 5 is an enlarged partial cross-sectional view illustrating a compressor when a solenoid is excited and a check valve is opened.
Figure 6:
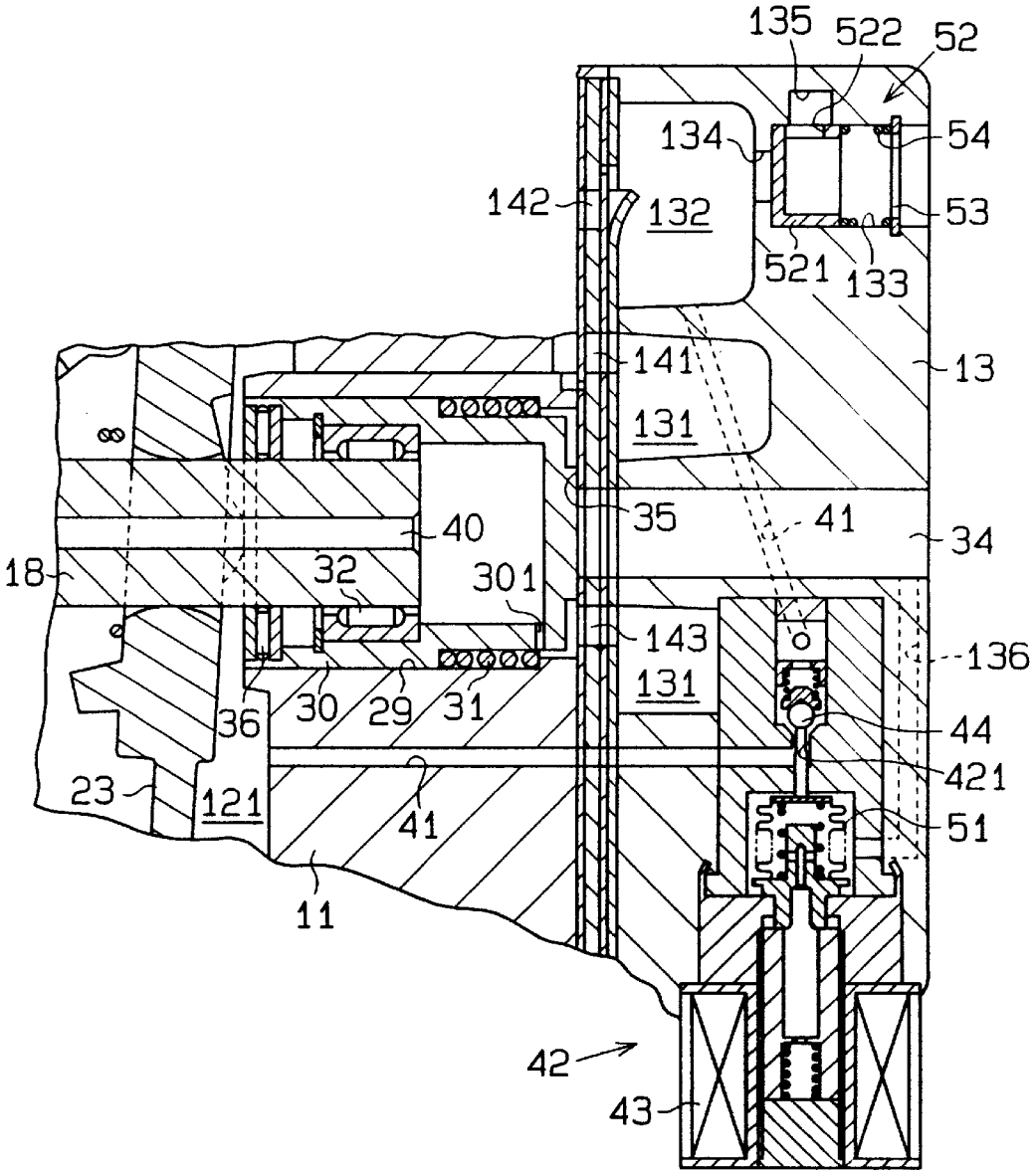
FIG. 6 is an enlarged partial cross-sectional view illustrating a compressor when a solenoid is excited and a check valve is closed.
Figure 7:
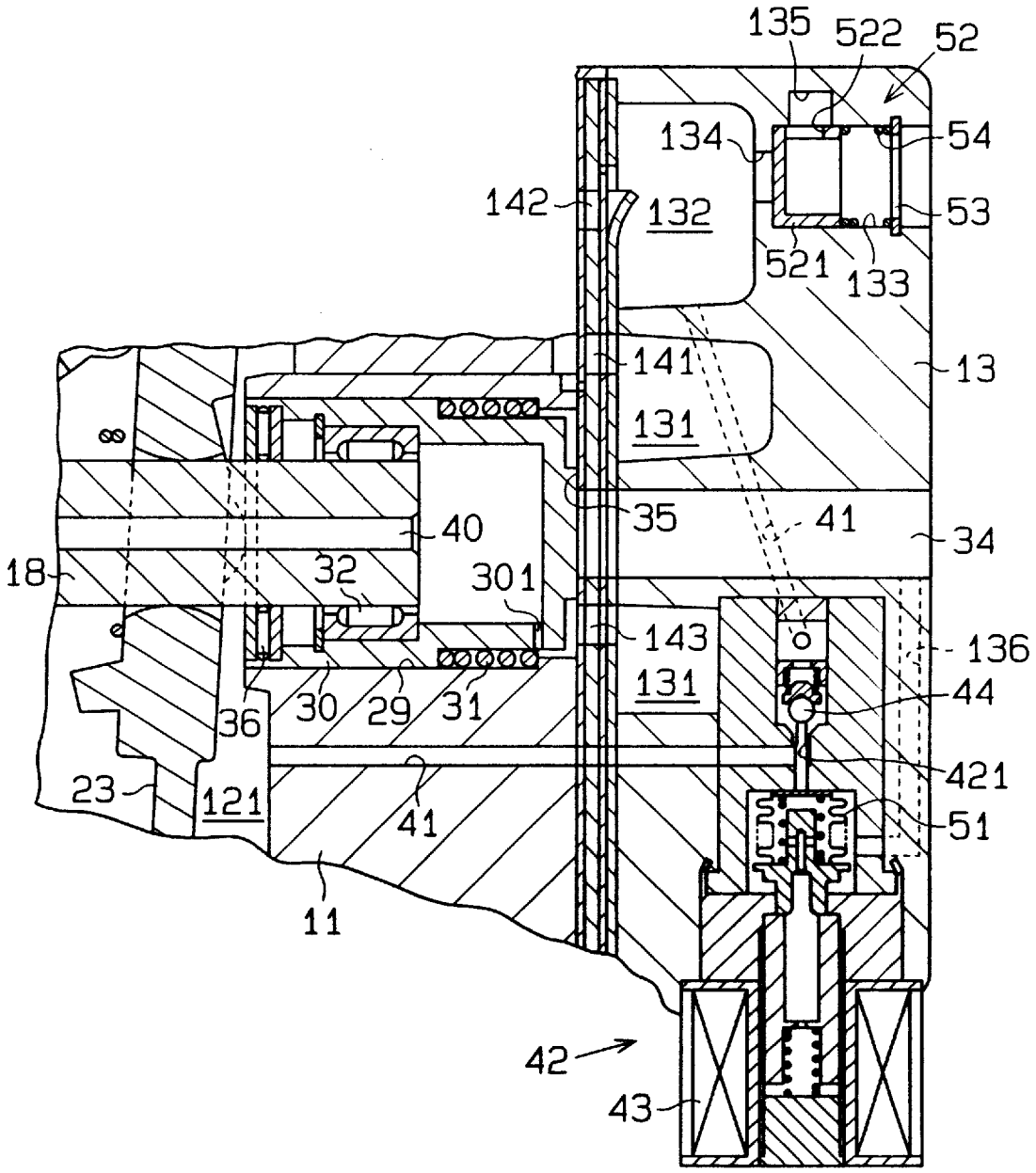
FIG. 7 is an enlarged partial cross-sectional view illustrating a compressor when a solenoid is de-excited and a check valve is closed.

As shown in FIGS. 1 and 5, a check valve 52 is accommodated in the discharge passage 133. The check valve 52 includes a hollow cylindrical valve body 521, a snap ring 53 fitted in a groove on the inner wall of the discharge passage 133 and a spring 54 located between the valve body 521 and the snap ring 53. The valve body 521 slides along the axis of the passage 133. A valve hole 134 communicates the discharge chamber 132 with the discharge passage 133. The spring 54 urges the valve body 521 toward the inner end the discharge passage 133, that is, in the closed direction of the valve hole 134. A detour recess 135 is defined in the inner wall of the discharge passage 133 between the valve hole body 134 and the circlip snap ring 53. The detour recess 135 constitutes a part of the discharge passage 133 A through hole 522 is formed in the peripheral wall of the valve body 521. As shown in FIGS. 1 and 5, when the valve body 521 is at a position to open the valve hole 134, the refrigerant gas in the discharge chamber 132 is discharged to the external refrigerant circuit 45 through the valve hole 134, the detour recess 135, the through hole 522 and the interior of the valve body 521. As shown in FIGS. 6 and 7, when at a position to close the valve hole 134, the valve body 521 prevents the refrigerant gas in the discharge chamber 132 from being discharged to the external refrigerant circuit 45.

As shown in FIGS. 1 and 5, a supply passage 41 is defined in the rear housing 13, the first to fourth plates 14 to 17 and the cylinder block 11. The supply passage 41 communicates the discharge chamber 132 with the crank chamber 121. A displacement control valve 42 is accommodated in the rear housing 13 to be located midway in the supply passage 41. The control valve 42 has a valve body 44, a bellows 51 and a solenoid 43. The valve body 44 selectively opens or closes a valve hole 421. The opening defined by the valve body 44 and valve hole 421 is controlled by the bellows 51.

When the solenoid 43 is de-excited, the valve body 44 opens the valve hole 421, thereby allowing the refrigerant gas in the discharge chamber 132 to enter the crank chamber 121 through the supply passage 41. The pressure of the suction passage 34 (suction pressure) acts on the bellows 51 through a passage 136. The suction pressure of the suction passage 34 reflects the cooling load. When the solenoid 43 is excited, the opening between the valve body 44 and the valve hole 421 is controlled in accordance with the suction pressure acting on the bellows 51. In other words, the flow rate of refrigerant gas from the discharge chamber 132 to the crank chamber 121 is controlled in accordance with the cooling load. The pressure in the crank chamber 121 is controlled, accordingly.

A switch 50 for actuating an air conditioner is connected to a computer C. The computer C excites the solenoid 43 when the switch 50 is turned on. The computer C de-excites the solenoid 43 when the switch is turned off.

The operation of the above described variable displacement compressor will now be described.

In the FIGS. 5 and 6, the solenoid 43 in the control valve 42 is excited. In this state, when the gas pressure in the suction passage 34 increases in accordance with an increase in the cooling load, the bellows 51 is shrunk to narrow the opening defined by the valve body 44 and the valve hole 421 as shown in FIG. 5. This decreases the gas flow from the discharge chamber 132 to the crank chamber 121 through the supply passage 41. On the other hand, the refrigerant gas in the crank chamber enters the suction chamber 131 through the pressure release hole 40, the interior of the shutter 30, the pressure release hole 301, the shutter chamber 29 and the communication hole 143. The pressure in the crank chamber 121 drops, accordingly. This reduces the pressure difference between the crank chamber 121 and the cylinder bores 111, thereby increasing the inclination of the swash plate 23. The displacement is thus increased.

An extremely large cooling load, in other words, an extremely high gas pressure in the suction passage 34, causes the valve body 44 to close the valve hole 421. This closes the supply passage 41. The highly pressurized refrigerant gas in the discharge chamber 132 does not enter the crank chamber 121 at all. This maximizes the inclination of the swash plate 23 as shown in FIG. 1. The compressor starts operating at the maximum displacement, accordingly. The abutment of the swash plate 23 against a projection 224 projecting from the rear end face of the rotor 22 prevents the inclination of the swash plate 23 beyond the predetermined maximum inclination.

With the solenoid 43 excited, when the gas pressure in the suction passage 34 drops in accordance with a decrease in the cooling load, the bellows 51 is extended to enlarge the opening defined by the valve body 44 and the valve hole 421 as shown in FIG. 6. This increases the gas flow from the discharge chamber 132 to the crank chamber 121 through the supply passage 41, thereby increasing the pressure in the crank chamber 121. This enlarges the pressure difference between the crank chamber 121 and the cylinder bores 111, thereby decreasing the inclination of the swash plate 23. The displacement is thus decreased.

An extremely small cooling load, in other words, an extremely low gas pressure in the suction passage 34, enlarges the opening defined by the valve body 44 and the valve hole 421. This increases the amount of refrigerant gas that enters the crank chamber 121 from the discharge chamber 132, thereby minimizing the inclination of the swash plate 23. The compressor starts operating at the minimum displacement, accordingly. Further, de-exciting the solenoid 43 in the control valve 42 maximizes the opening defined by the valve body 44 and the valve hole 421 as shown in FIG. 7. This minimizes the inclination of the swash plate 23 and causes the compressor to operate at its minimum displacement.

When the inclination of the swash plate 23 is minimized, the shutter 30 contacts the positioning surface 35. The abutment of the shutter 30 against the positioning surface 35 disconnects the suction passage 34 from the suction chamber 131. The shutter 30 slides in accordance with the inclination of the swash plate 23. Therefore, as the inclination of the swash plate 23 decreases, the shutter 30 gradually reduces the cross-sectional area of the gas flow passage from the suction passage 34 to the suction chamber 131. This gradually reduces the amount of refrigerant gas that enters the suction chamber 131 from the suction passage 34. The amount of refrigerant gas that is drawn into the cylinder bores 111 from the suction chamber 131 gradually decreases, accordingly. As a result, the displacement of the compressor gradually decreases. This gradually reduces the discharge pressure. The load torque of the compressor gradually decreases, accordingly. In this manner, the load torque of the compressor does not change dramatically in a short time. The shock that accompanies load torque fluctuations is thus lessened.

As shown in FIGS. 6 and 7, the abutment of the shutter 30 against the positioning surface 35 prevents the inclination of the swash plate 23 from being smaller than the predetermined minimum inclination. The abutment also disconnects the suction passage 34 from the suction chamber 131. This stops gas flow from the external refrigerant circuit 45 to the suction chamber 131, thereby stopping the circulation of the refrigerant gas between the circuit 45 and the compressor. An extremely low gas pressure in the suction passage 34 may cause the temperature of the evaporator 48 to drop to the frost forming temperature. In this case, however, the compressor operates at the minimum displacement and the gas circulation between the external refrigerant circuit 45 and the compressor is stopped. This prevents frost in the evaporator 48.

The minimum inclination of the swash plate 23 is slightly larger than zero degrees. Zero degrees refers to the angle of the swash plate's inclination when it is perpendicular to the axis of the drive shaft 18. Therefore, even if the inclination of the swash plate 23 is minimum, refrigerant gas is discharged to the discharge chamber 132 from the cylinder bores 111 and the compressor operates at the minimum displacement. The refrigerant gas discharged to the discharge chamber 132 from the cylinder bores 111 is drawn into the crank chamber 121 through the supply passage 41. The refrigerant gas in the crank chamber 121 is drawn back into the cylinder bores 111 through the pressure release passage 40, a pressure release hole 301 and the suction chamber 131. That is, when the inclination of the swash plate 23 is minimum, refrigerant gas circulates within the compressor traveling through the discharge chamber 132, the supply passage 41, the crank chamber 121, the pressure release passage 40, the pressure release hole 301, the suction chamber 131 and the cylinder bores 111. This circulation of refrigerant gas allows the lubricant oil contained in the gas to lubricate each sliding part in the compressor.

When the compressor is operating at the minimum displacement, in other words, when the inclination of the swash plate 23 is minimum, the displacement pressure decreases. The spring 54 has a force that is greater than a predetermined level. That is, the magnitude of the spring's force is determined such that, when the compressor is operating at the minimum displacement, the sum of the force of the spring 54 and the pressure at the downstream of the check valve 52 (the pressure of the area connected to the external refrigerant circuit 45) is greater than the pressure at the upstream of the check valve 52 (the pressure of the area connected to the discharge chamber 132). Therefore, with the minimum inclination of the swash plate 23, the valve body 521 closes the valve hole 134, thereby disconnecting the discharge chamber 132 from the external refrigerant circuit 45.

As the swash plate's inclination increases from the state illustrated in FIGS. 6 and 7, the force of the spring 31 gradually pushes the shutter 30 away from the positioning surface 35. This gradually enlarges the cross-sectional area of gas flow from the suction passage 34 to the suction chamber 131. Accordingly, the amount of refrigerant gas from the suction passage 34 into the suction chamber 131 gradually increases. Therefore, the amount of refrigerant gas that is sucked into the cylinder bores 111 from the suction chamber 131 gradually increases. The displacement of the compressor gradually increases, accordingly. The discharge pressure of the compressor gradually increases and the load torque of the compressor also gradually increases. In this manner, the load torque of the compressor does not dramatically change in a short time. The shock that accompanies load torque fluctuations is thus lessened.

When the discharge pressure of the compressor increases as the inclination of the swash plate 23 increases, the pressure upstream of the check valve 52 becomes greater than the sum of the force resulting from the pressure downstream of the valve 52 and the force of the spring 54. Therefore, when the inclination of the swash plate 23 is greater than the minimum inclination, the valve body 521 opens the valve hole 134, thereby allowing the refrigerant gas in the discharge chamber 132 to be discharged to the external refrigerant circuit 45 through the discharge passage 133.

If the engine E is stopped, the compressor is also stopped (that is, the rotation of the swash plate 23 is stopped) and the solenoid 43 in the control valve 42 is de-excited. In this state, the inclination of the swash plate 23 is minimal as shown in FIG. 7. If the nonoperational state of the compressor continues, the pressure in the compressor is uniformized, while the swash plate 23 is kept at the minimum inclination by the force of the spring 28. Therefore, when the engine E is started again, the compressor starts operating with the swash plate at the minimum inclination with the minimum torque. This minimizes the shock caused by starting the compressor.

The valve in the compressor according to the above cited Japanese Unexamined Patent Publication No. 7-127566 selectively opens or closes the discharge passage that connects the discharge chamber with the external refrigerant circuit based on the difference between the discharge pressure acting on one side of the valve body and the suction pressure acting on the other side of the valve body. Therefore, when the difference between the discharge pressure and the suction pressure is large, the highly pressurized gas in the discharge chamber leaks into the suction pressure area through the clearance between the periphery of the valve body and the inner wall of the chamber accommodating the valve body.

In the above described compressor, unlike the prior art compressor described in the Background section, the discharge passage 133 simply connects the discharge chamber 132 with the external refrigerant circuit 45. The check valve 52 located in the discharge passage 133 selectively opens or closes the discharge passage 133 based on the difference between the pressure acting on the upstream end and the pressure acting on the downstream end of the check valve 52. That is, the compressor according FIG. 1 is designed such that the suction pressure does not act on the check valve 52. This prevents the refrigerant gas in the discharge chamber 132 from leaking into the suction pressure area. Accordingly, the refrigerant efficiency of the external refrigerant circuit 45 is improved.

The compressor according to Japanese Unexamined Patent Publication No. 7-127566 has a passage that is designed to introduce the pressure in the suction pressure area to the valve. Such a passage complicates the structure and manufacture of compressors. In the present invention, unlike the prior art, only the check valve 52 is placed in the discharge passage 133 that connects the discharge chamber 132 with the external refrigerant circuit 45. Therefore, there is no necessity for forming a passage to introduce suction pressure to the check valve 52. This simplifies the compressor's structure and facilitates the manufacture.

Compared to the condenser 46 and the evaporator 48, which function as heat exchangers on the circuit 45, the temperature of the compressor falls quickly when it stops operating. Therefore, when the compressor is not operating, refrigerant is apt to be drawn into the compressor from the external refrigerant circuit 45. If it is drawn into the compressor, the refrigerant is liquefied and stays in there. The liquefied refrigerant dilutes the lubricant in the compressor and washes the parts that requires lubrication.

However, in the present invention, when the inclination of the swash plate 23 is minimal, the check valve 52 prevents the refrigerant in the external refrigerant circuit 45 from leaking into the discharge chamber 132. Further, the shutter 30 prevents the refrigerant in the circuit 45 from leaking into the suction chamber 131. Therefore, liquefied lubricant does not stay in the compressor.

When the inclination of the swash plate 23 is minimum, the valve body 44 in the control valve 42 opens the valve hole 421. In this state, refrigerant gas circulates within the compressor traveling through the discharge chamber 132, the supply passage 41, the crank chamber 121, the pressure release passage 40, the suction chamber 131 and the cylinder bores 111. When the swash plate's inclination is minimal, backflow of refrigerant gas to the discharge chamber 132 from the external refrigerant circuit 45 increases the pressure in the crank chamber 121. When the inclination of the swash plate 23 increases from the minimum inclination, that is, when the compressor's displacement increases from the smallest, the lower the pressure in the crank chamber 121 is, the more quickly the compressor's displacement increases. In the above described embodiment, when the inclination of the swash plate 23 is minimum, the check valve 52 prevents backflow of refrigerant gas from the circuit 45 to the suction chamber 131. This maintains the pressure in the crank chamber 121 at a low level, thereby allowing the compressor to increase its displacement quickly.

Figure 9:
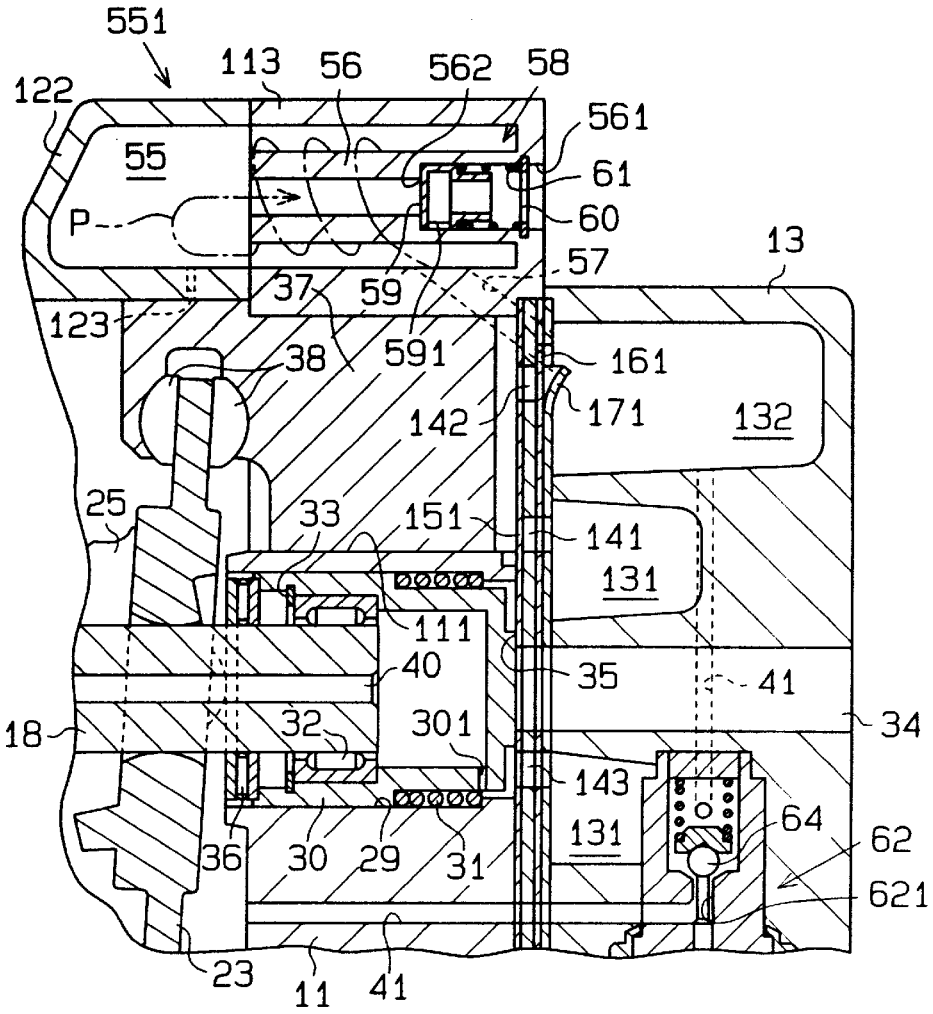
FIG. 9 is an enlarged partial cross-sectional view illustrating a compressor when a check valve is closed.
Figure 10:
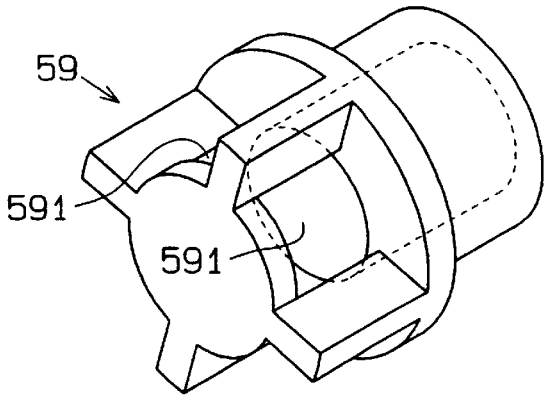
FIG. 10 is a perspective view illustrating a check valve.

A second embodiment of the present invention will now be described with reference to FIGS. 8 to 10. Like or same reference numerals are given to those components that are like or the same as the corresponding components of the first embodiment.

An electromagnetic valve 62 is accommodated in the rear housing 13. The valve 62 is located midway in the supply passage 41. As shown in FIG. 8, exciting a solenoid 63 in the electromagnetic valve 62 causes a valve body 64 to close a valve hole 621. As shown in FIG. 9, de-exciting the solenoid 63 causes the valve body 64 to open the valve hole 621. The electromagnetic valve 62 selectively opens or closes the supply passage 41, which communicates the discharge chamber 132 with the crank chamber 121.

A temperature sensor 49 is located in the vicinity of the evaporator 48. The temperature sensor 49 detects the temperature of the evaporator 48 and sends data of the detected temperature to a computer C. The computer C controls the solenoid 63 in the electromagnetic valve 62 based on the data from the sensor 49. Specifically, when the switch 50 is turned on, the computer C de-excites the solenoid 63 if the temperature detected by the temperature sensor 49 becomes equal to or lower than a predetermined temperature. This opens the valve hole 621, thereby preventing frost in the evaporator 48. When the switch 50 is turned off, the computer C de-excites the solenoid 63 to open the valve hole 621.

Figure 8:
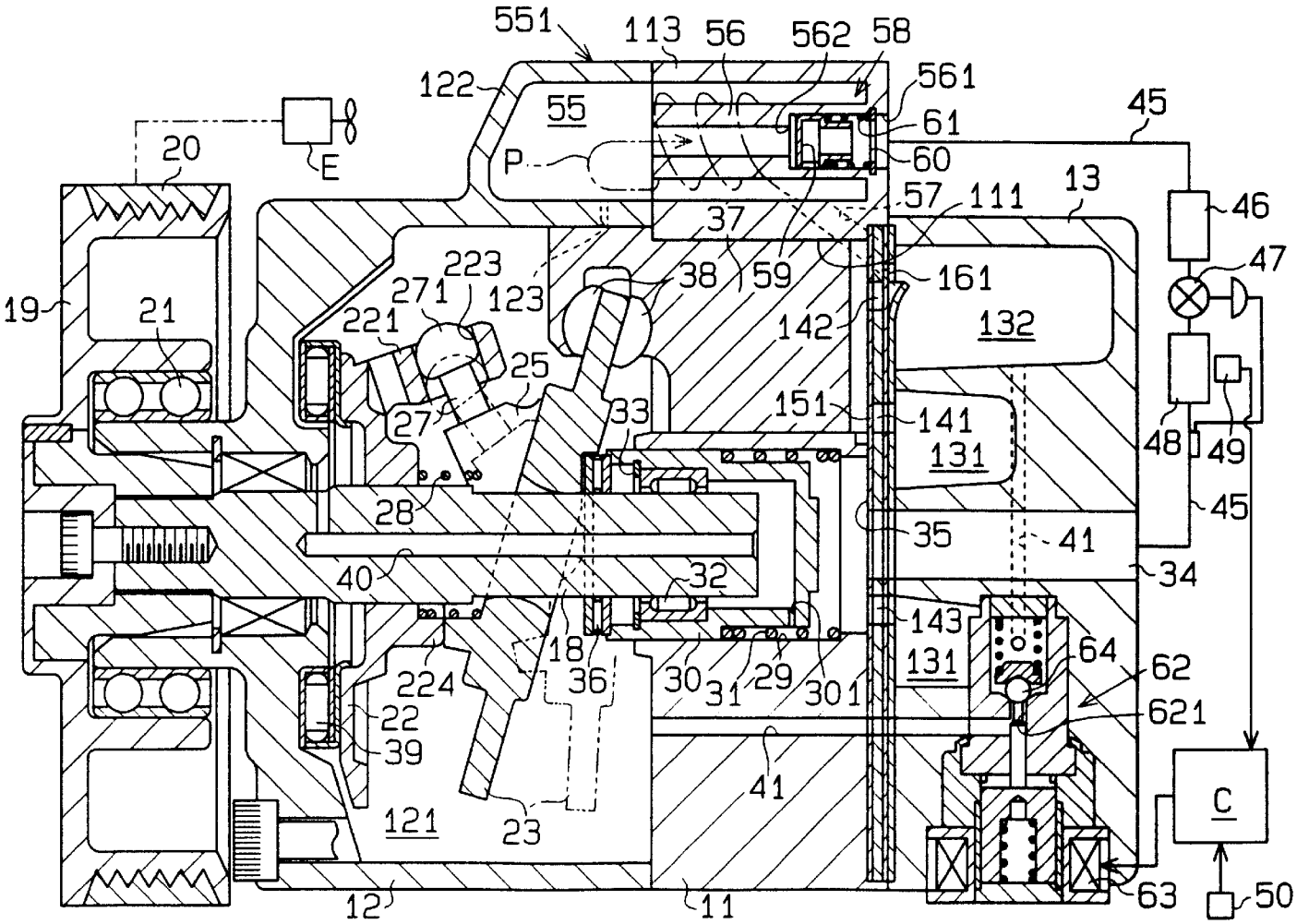
FIG. 8 is a cross-sectional view illustrating a variable displacement compressor according to a second embodiment of the present invention.

FIG. 8 shows a state, in which the solenoid 63 in the valve 62 is excited for closing the valve hole 621 by the valve body 64, thereby closing the supply passage 41. The high pressurized refrigerant gas in the discharge chamber 132 is not supplied to the crank chamber 121. The refrigerant gas in the crank chamber 121 enters the suction chamber 131 through the pressure release passage 40 and the pressure release hole 301. The pressure in the crank chamber 121 approaches the low pressure in the suction chamber, that is, the suction pressure. This decreases the difference between the pressure in the crank chamber 121 and the pressure in the cylinder bores 111. The inclination of the swash plate 23 is thus maximized and the compressor operates at the maximum displacement.

When the compressor is operating with the swash plate inclination being maximum, a decrease in the cooling load causes the temperature of the evaporator 48 in the external refrigerant circuit 45 to gradually drop. When the evaporator's temperature is equal to or below the frost forming temperature, the computer C de-excites the solenoid 63 based on the detection signal from the temperature sensor 49. De-exciting the solenoid 63 causes the valve body 64 to open the valve hole 621 as shown in FIG. 9. This supplies the highly pressurized refrigerant gas in the discharge chamber 132 to the crank chamber 121 through the supply passage 41, thereby increasing the pressure in the crank chamber 121. The difference between the pressure in the crank chamber 121 and the pressure in the cylinder bore 111 is thus enlarged. This moves the swash plate 23 from the maximum inclination to the smallest inclination. The compressor thus starts operating at the minimum displacement. Turning the switch 50 off also de-excites the solenoid 63, thereby moving the swash plate 23 to the minimum inclination.

A discharge muffler 551 is formed in the upper portion of the cylinder block 11 and the front housing 12. The discharge muffler 551 includes a first housing 113 and a second housing 122. The first housing 113 is integrally formed with the cylinder block 11 on its periphery and the second housing 122 is integrally formed with the front housing 12 on its periphery. The muffler chamber 55 is defined in the first and second housings 113, 122. A cylindrical oil separator 56 is integrally formed with the first housing 113 and is located in the muffler chamber 55. A communication passage 57 communicates the muffler chamber 55 with the discharge chamber 132. A narrow oil passage 123 communicates the muffler chamber 55 with the crank chamber 121.

A passage defined in the oil separator 56 is connected to the external refrigerant circuit 45. A portion of the passage that is connected to the circuit 45 constitutes a discharge passage 561. A check valve 58 is accommodated in the discharge passage 561. The check valve 58 includes a hollow cylindrical valve body 59, a snap ring 60 fitted in a groove on the inner wall of the discharge passage 561 and a spring 61 located between the valve body 59 and the snap ring 60. The valve body 59 slides in the discharge passage 561 along the axis of the passage 561. The inner end of the discharge passage 561 constitute a valve hole 562. The spring 61 urges the valve body 59 toward the inner end of the discharge passage 561, that is, in the closed direction of the valve hole 562. As shown in FIG. 10, a plurality of through holes 591 are formed in the periphery of the valve body 59. The check valve 58 has the same functions as the check valve 52 of the first embodiment.

The refrigerant gas discharged to the discharge chamber 132 from the cylinder bore 111 enters the muffler chamber 55 through the communication passage 57. This prevents pulsation and noise caused by the gas flow from the cylinder bores 111 to the discharge chamber 132. The refrigerant gas drawn into the muffler chamber 55 circles about the oil separator 56 before entering the inner passage of the separator 56 as illustrated by an arrow P in FIG. 8. The refrigerant gas pushes the valve body 59 and flows out to the external refrigerant circuit 45 through the through holes 591 and the interior of the valve body 59.

The circular motion of the refrigerant gas about the oil separator 56 results in a centrifugation effect. The effect separates mistlike lubricant from the refrigerant gas. The separated lubricant drops on the bottom of the muffler chamber 55. The lubricant is thus positively separated from the refrigerant gas. This prevents the lubricant from being discharged from the compressor with the refrigerant gas. The lubricant on the bottom of the muffler chamber 55 is supplied to the crank chamber 121 through the oil passage 123. The lubricant then is then available in the crank chamber 121 for lubrication.

In addition to the advantages of the first embodiment, the second embodiment has the following advantages.

The check valve 58 is accommodated in the discharge passage 561 defined in the oil separator 56. This simplifies the structure of the discharge passage for accommodating the check valve 58.

Employing the check valve 58 according to the second embodiment eliminates the necessity for the detour recess 135. This simplifies the structure of the discharge passage compared to that of the first embodiment.

Figure 11:
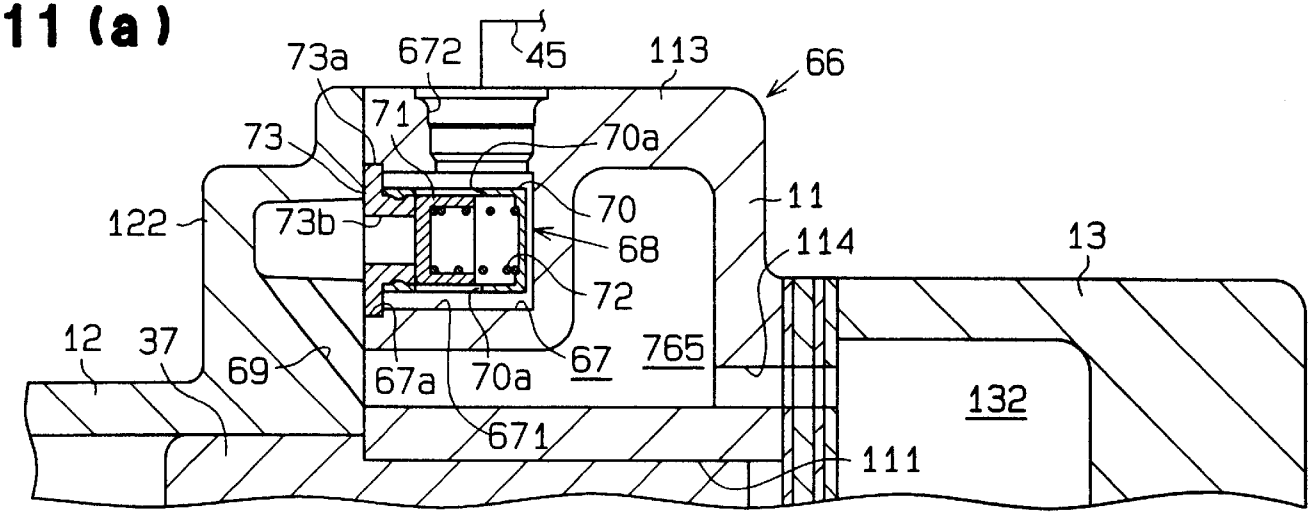
FIG. 11(*a*) is an enlarged partial cross-sectional view illustrating a compressor according to a third embodiment when a check valve is closed.
Figure 11:
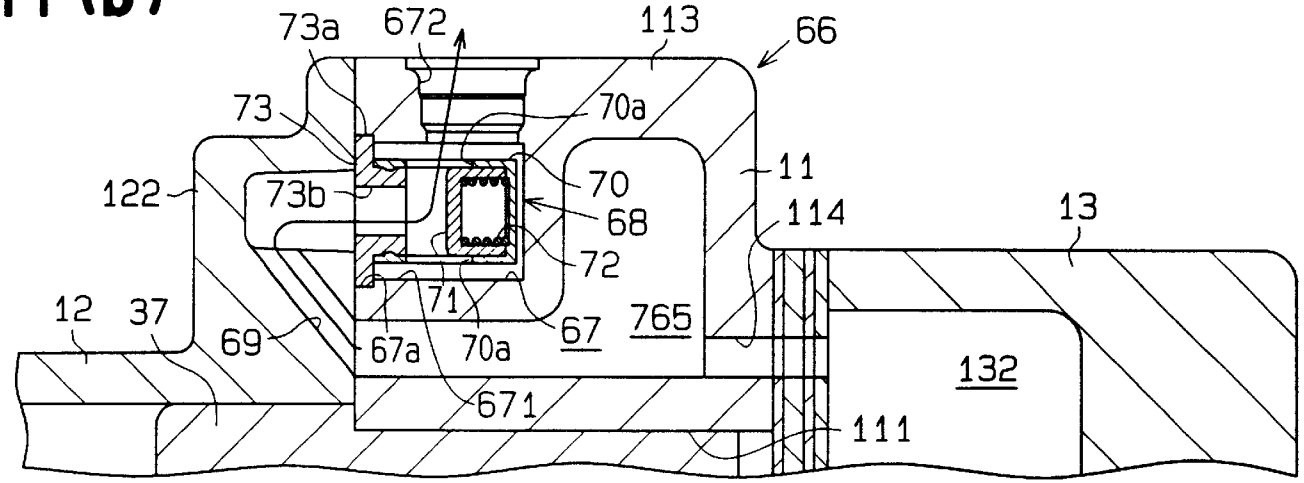

A third embodiment of the present invention will now be described with reference to FIGS. 11(*a*) and 11(*b*). Like or same reference numerals are given to those components that are like or the same as the corresponding components of the first and second embodiments.

A discharge muffler 66 is formed in the upper portion of the cylinder block 11 and the front housing 12. The discharge muffler 66 includes the first housing 113 and the second housing 122. The first housing 113 is integrally formed with the cylinder block 11 on its periphery and the second housing 122 is integrally formed with the front housing 12 on its periphery. A muffler chamber 765 is defined in the first housing 113. A communication passage 114 communicates the muffler chamber 65 with the discharge chamber 132. A discharge passage 67 is defined in the first housing 113. The discharge passage 67 includes a valve chamber 671 and a discharge port 672. A check valve 68 is accommodated in the valve chamber 671. The discharge port 672 is connected to the external refrigerant passage 45. The valve chamber 671 extends horizontally and its opening faces the second housing 122. The discharge port 672 extends vertically and opens at the top surface of the first housing 113. A passage 69 defined in the second housing communicates the muffler chamber 65 with the valve chamber 671.

The check valve 68 is an integrated component consisting of a casing 70, a valve body 71, a spring 72 and a spacer 73. The casing 70 has a hollow cylindrical form with one end closed. The valve body 71 also has a hollow cylindrical form with one end closed and is accommodated in the casing 70. The valve body 71 slides along the axis of the casing 70. The spring 72 urges the valve body 71 toward the open end of the casing 70. The spacer 73 is fitted in the open end of the casing 70. The end of the spacer 73 inserted in the casing 70 is engageable with the valve body 71. A flange 73*a* is formed at the other end of the spacer 73. A step 67*a* is defined at the open end of the valve chamber 671. The flange 73*a* is engageable with the step 67*a*.

The check valve 68 is inserted in the valve chamber 671 with the flange 73*a* engaged with the step 67*a*. The flange 73*a* is then held between the first housing 113 and the second housing 122. This fixes the check valve 68 with respect to the valve chamber 671. A valve hole 73*b* is defined in the spacer 73 for communicating the passage 69 with the interior of the casing 70. A plurality of through holes 70*a* are formed in the periphery of the casing 70.

The check valve 68 according to the third embodiment has the same advantages as the check valves 52 and 58 according to the first and second embodiments. When the compressor is operating at the minimum displacement, the valve body 71 closes the valve hole 73*b* as shown in FIG. 11(*a*). When the compressor is operating at a displacement larger than the minimum displacement, the pressure of the muffler chamber 65 allows the valve body 71 to open the valve hole 73*b*. The refrigerant gas in the muffler chamber 65 thus flows out to the external refrigerant circuit 45 through the passage 69, the valve hole 73*b*, the through holes 70*a* and the discharge port 672 as illustrated by an arrow in FIG. 11(*b*).

The check valve 68 according to the third embodiment is an integrated component consisting of a plurality of parts. Therefore, when assembling the compressor, the check valve 68 is installed in the valve chamber by simply inserting the valve 68, which is previously integrated, in the chamber 671. This simplifies the installing of the check valve in the valve chamber. Further, each of the parts constituting the check valve 68 is easily and precisely manufactured compared to those of the first and second embodiments, in which a part of the check valve is formed on the housing of the compressor. Therefore, for example, the inner end of the spacer 73, with which the valve body 71 engages when the valve hole 73*b* is closed, may be easily and precisely finished. This improves sealing of the spacer 73 and the valve body 71 when the valve hole 73*b* is closed.

The present invention may be adapted to a variable displacement compressor such as that disclosed in Japanese Unexamined Patent Publication No. 7-310654 having an electromagnetic valve in a passage that connects the crank chamber with the suction chamber.

Therefore, the present examples and embodiments are to be considered as illustrative and not restrictive and the invention is not to be limited to the details given herein but may be modified within the scope of the appended claims.

What is claimed is:

1. A compressor having a crank chamber a cylinder bore, a suction chamber and a discharge chamber, the compressor comprising a drive shaft extending into the crank chamber, a cam plate mounted on a drive shaft within the crank chamber and a piston coupled to the cam plate and located in the cylinder bore, wherein said cam plate converts rotation of the drive shaft to reciprocating movement of the piston in the cylinder bore, said piston compressing gas supplied to the cylinder bore from a separate external circuit by way of the suction chamber and discharging the compressed gas to the external circuit by way of the discharge chamber;

said cam plate being tiltable between a maximum inclined angle position and a minimum inclined angle position with respect to a plane perpendicular to an axis of the drive shaft according to a difference between the pressure in the crank chamber and the pressure in the cylinder bore, wherein said piston moves by a stroke based on the inclination of the cam plate to control the displacement of the compressor;

the compressor further comprising:

a discharge passage for connecting the discharge chamber with the external circuit;

a valve located in the discharge passage, said valve having an upstream side and a downstream side, said valve selectively connecting and disconnecting the discharge chamber with the external circuit based on a difference between the pressure acting on the upstream side of the valve and the pressure acting on the downstream side of the valve; and a discharge muffler for preventing pulsation caused by the flow of the gas discharged from the cylinder bore to the discharge chamber, wherein said discharge passage is defined in the discharge muffler.

2. The compressor according to claim 1, wherein said valve disconnects the discharge chamber from the external circuit when the cam plate is at the minimum inclined angle position to minimize the displacement of the compressor.

3. The compressor according to claim 2, wherein said valve connects the discharge chamber with the external circuit when the inclination of the cam plate is greater than the minimum inclined angle position.

4. The compressor according to claim 1, wherein said valve includes a check valve that allows only the compressed gas to be discharged from the discharge chamber to the external circuit.

5. The compressor according to claim 4, wherein said valve includes:

a valve body movable between a first position and a second position, said valve body connecting the discharge chamber with the external circuit at the first position, and said valve body disconnecting the discharge chamber from the external circuit at the second position; and means for urging the valve body toward the second position.

6. The compressor according to claim 5, wherein said valve includes a member for accommodating said valve body and said urging means, and said valve is an integrated component including the accommodating member, the valve body and the urging means.

7. The compressor according to claim 6 further comprising:

a pair of housings respectively having end faces secured to one another; and wherein said valve has a flange clamped by the end faces of the housings to secure the valve to the housings.

8. The compressor according to claim 6, wherein said accommodating member includes a casing having a shape of a hollow cylinder with an open end and a spacer fitted in the open end of the casing, said casing having a through hole for providing communication from the interior of the casing to the external circuit, and said spacer having a valve hole for providing communication from the interior of the casing of the discharge chamber and an inner end surface inserted in the casing so as to face the valve body, and wherein said valve body abuts against the inner end surface for closing the valve hole to block the communication of the valve hole with the through hole via the interior of the casing when the valve body is at the second position.

9. The compressor according to claim 1 further comprising:

a supply passage for connecting the discharge chamber with the crank chamber to deliver the gas from the discharge chamber to the crank chamber;

a release passage for connecting the crank chamber with the suction chamber to deliver the gas from the crank chamber to the suction chamber; and control means disposed midway along the supply passage for adjusting the amount of the gas introduced into the crank chamber from the discharge chamber through the supply passage to control the pressure in the crank chamber.

10. The compressor according to claim 9 further comprising a shutter member movable between a first position and a second position in response to the inclination of the cam plate, said shutter member connecting the external circuit with the suction chamber at the first position and disconnecting the external circuit from the suction chamber at the second position, wherein said cam plate moves the shutter member to the second position when the cam plate is at the minimum inclined angle position to minimize the displacement of the compressor.

11. The compressor according to claim 10 further comprising:

a positioning surface facing the shutter member; and wherein said shutter member has an end surface abutting against the positioning surface when the shutter member is positioned in the second position; and said cam plate is held at the minimum inclined angle position when the shutter member is positioned in the second position.

12. The compressor according to claim 10 further comprising a gas circulating passage including said release passage and said supply passage, said circulating passage being defined upon disconnection of the external circuit from the suction chamber.

13. The compressor according to claim 1 further comprising an external driving source coupled directly to the drive shaft to operate the compressor.

14. A compressor having a crank chamber, a cylinder bore, a suction chamber and a discharge chamber, the compressor comprising a drive shaft extending into the crank chamber, a cam plate mounted on the drive shaft within the crank chamber and a piston coupled to the cam plate and located in the cylinder bore, wherein said cam plate converts rotation of the drive shaft to reciprocating movement of the piston in the cylinder bore, said piston compressing gas supplied to the cylinder bore from a separate external circuit by way of the suction chamber and discharging the compressed gas to the external circuit by way of the discharge chamber, said;

said cam plate being tiltable between a maximum inclined angle position and a minimum inclined angle position with respect to a plane perpendicular to an axis of the drive shaft according to a difference between the pressure in the crank chamber and the pressure in the cylinder bore, wherein said piston moves by a stroke based on the inclination of the cam plate to control the displacement of the compressor;

the compressor further comprising:

a supply passage for connecting the discharge chamber with the crank chamber to deliver the gas from the discharge chamber to the crank chamber;

a release passage for connecting the crank chamber with the suction chamber to deliver the gas from the crank chamber to the suction chamber;

control means disposed midway along the supply passage for adjusting the amount of the gas introduced into the crank chamber from the discharge chamber through the supply passage to control the pressure in the crank chamber;

a discharge passage for connecting the discharge chamber with the external circuit;

a valve located in the discharge passage, said valve having an upstream side and a downstream side, said valve selectively connecting and disconnecting the discharge chamber with the external circuit based on a difference between the pressure acting on the upstream side of the valve and the pressure acting on the downstream side of the valve, said valve disconnecting the discharge chamber from the external circuit when the cam plate is at the minimum inclined angle position to minimize the displacement of the compressor; and a discharge muffler for preventing pulsation caused by the flow of the gas discharged from the cylinder bore to the discharge chamber, wherein said discharge passage is defined in the discharge muffler.

15. The compressor according to claim 14, wherein said valve includes a check valve that allows only the compressed gas to be discharged from the discharge chamber to the external circuit.

16. The compressor according to claim 15, wherein said valve includes:

a valve body movable between a first position and a second position, said valve body connecting the discharge chamber with the external circuit at the first position, and said valve body disconnecting the discharge chamber from the external circuit at the second position; and means for urging the valve body toward the second position.

17. The compressor according to claim 16, wherein said valve includes a member for accommodating said valve body and said urging means, and said valve is an integrated component including the accommodating member, the valve body and the urging means.

18. The compressor according to claim 17 further comprising:

a pair of housings respectively having end faces secured to one another;

wherein said valve has a flange clamped by the end faces of the housing to secure the valve to the housings.

19. The compressor according to claim 17, wherein said accommodating member includes a casing having a shape of a hollow cylinder with an open end and a spacer fitted in the open end of the casing, said casing having a through hole for providing communication from the interior of the casing to the external circuit, and said spacer having a valve hole for providing communication from the interior of the casing to the discharge chamber and an inner end surface inserted in the casing so as to face the valve body, and wherein said valve body abuts against the inner end surface for closing the valve hole to block the communication of the valve hole with the through hole via the interior of the casing when the valve body is at the second position.

20. The compressor according to claim 16 further comprising a shutter member movable between a first position and a second position in response to the inclination of the cam plate, said shutter member connecting the external circuit with the suction chamber at the first position and disconnecting the external circuit from the suction chamber at the second position, wherein said cam plate moves the shutter member to the second position when the cam plate is at the minimum inclined angle position to minimize the displacement of the compressor.

21. The compressor according to claim 20 further comprising:

a positioning surface facing the shutter member;

said shutter member having an end surface abutting against the positioning surface when positioned in the second position; and said cam plate being held at the minimum inclined angle position when the shutter member is positioned in the second position.

22. The compressor according to claim 20 further comprising a gas circulating passage including said release passage and said supply passage, said circulating passage being defined upon disconnection of the external circuit from the suction chamber.

23. The compressor according to claim 20 further comprising an external driving source coupled directly to the drive shaft to operate the compressor.

24. The compressor according to claim 14, wherein said valve connects the discharge chamber with the external circuit when the inclination of the cam plate is greater than the minimum inclined angle position.

25. A compressor for compressing gas supplied from an external circuit and discharging the compressed gas to the external circuit, the compressor comprising:

a pair of housings having respective end faces secured to one another;

a crank chamber, a cylinder bore and a discharge chamber defined by the housings;

a drive shaft supported by the housings;

a cam plate located in the crank chamber and mounted on the drive shaft, wherein the cam plate is inclined with respect to a plane perpendicular to an axis of the drive shaft according to the pressure in the crank chamber;

a piston coupled to the cam plate and located in the cylinder bore, wherein the cam plate converts rotation of the drive shaft to reciprocating movement of the piston within the cylinder bore, whereby the piston compresses gas supplied from the external circuit and discharges the compressed gas to the discharge chamber, and the piston moves by a stroke based on the inclination of the cam plate to control the displacement of the compressor; and a valve between the discharge chamber and the external circuit, the valve having a flange clamped by the end faces of the housings to secure the valve to the housings, the valve having an upstream side and a downstream side, wherein the valve selectively connects and disconnects the discharge chamber with the external circuit based on a difference between the pressure acting on the upstream side of the valve and the pressure acting on the downstream side of the valve.

* * * * *

UNITED STATES PATENT AND TRADEMARK OFFICE

CERTIFICATE OF CORRECTION

PATENT NO. : 6,203,284 B1 
DATED : March 20, 2001
INVENTOR(S) : Masahiro Kawaguchi et al.

It is certified that error appears in the above-identified patent and that said Letters Patent is hereby corrected as shown below:

Column 5,
Line 51, delete “body” and “circlip”;

Column 12,
Line 67, please change “a drive shaft” to -- the drive shaft --;

Column 14,
Line 1, please change “casing of” to -- casing to --;
Line 55, please change “chamber, said;” to -- chamber; --.

Signed and Sealed this

Eighth Day of April, 2003

JAMES E. ROGAN
*Director of the United States Patent and Trademark Office*